US008322523B2

(12) United States Patent
Palmer

(10) Patent No.: US 8,322,523 B2
(45) Date of Patent: Dec. 4, 2012

(54) OBLONG OBJECT HOLDER

(76) Inventor: David H. Palmer, Winter, WI (US)

( * ) Notice: Subject to any disclaimer, the term of this patent is extended or adjusted under 35 U.S.C. 154(b) by 25 days.

(21) Appl. No.: 12/924,596

(22) Filed: Sep. 30, 2010

(65) Prior Publication Data

US 2011/0073498 A1 Mar. 31, 2011

Related U.S. Application Data

(60) Provisional application No. 61/277,795, filed on Sep. 30, 2009.

(51) Int. Cl.
*A45C 11/32* (2006.01)

(52) U.S. Cl. ..... 206/37.1; 206/37.5; 206/39.4

(58) Field of Classification Search ..... 206/37.1, 206/37.2, 39.1, 39.4, 37.5, 37.8
See application file for complete search history.

(56) References Cited

U.S. PATENT DOCUMENTS

| | | | | |
|---|---|---|---|---|
| 1,537,723 | A | | 5/1925 | Youngberg |
| 2,047,331 | A | | 7/1936 | Pollak |
| 2,076,895 | A | | 4/1937 | Johnston |
| 2,198,110 | A | | 4/1940 | Fischer |
| 2,306,970 | A | | 12/1942 | MacPherson et al. |
| 2,517,500 | A | | 8/1950 | McPherson et al. |
| 2,560,595 | A | | 7/1951 | Poncar |
| 2,566,118 | A | | 8/1951 | Corwin et al. |
| 2,593,441 | A | | 4/1952 | Hager et al. |
| 2,869,352 | A | | 1/1959 | Huntley |
| 3,315,504 | A | | 4/1967 | Billings, Jr. |
| 3,481,169 | A | | 12/1969 | Rossi |
| 3,618,346 | A | | 11/1971 | Humphrey |
| 3,733,862 | A | | 5/1973 | Killmeyer |
| 4,043,203 | A | * | 8/1977 | Montesi ..... 73/427 |
| 4,144,523 | A | | 3/1979 | Kaplit |
| 4,326,124 | A | | 4/1982 | Faude |
| 4,562,712 | A | | 1/1986 | Wolter |
| 4,596,126 | A | | 6/1986 | Sorensen |
| 4,646,913 | A | | 3/1987 | Wing et al. |
| 4,663,952 | A | | 5/1987 | Gelhard |
| 4,686,358 | A | | 8/1987 | Seckinger et al. |

(Continued)

OTHER PUBLICATIONS

The Search Report and Written Opinion in counterpart foreign Application No. PCT/US10002646 filed Sep. 30, 2010.

*Primary Examiner* — David Fidei
*Assistant Examiner* — Raven Collins

(57) ABSTRACT

A holder of oblong objects pivotably mounted therein so as to be selectively positionable and selectively retainable therein comprising a pair of oblong sidewall structures spaced apart from one another each having a mounting side end across from one another with at least one of said pair of oblong structures having a sidewall opening at the mounting end thereof extending therethrough. A pivot pin is positionable in said sidewall opening, and also removable therefrom. An oblong object holder has a connection structure at a connection end thereof and supports a selected object to be held in the holder at an opposite support end thereof with the connection structure having a pair of connection bars each extending away from the support end and about an opposite side of a connection opening between them to result in gap ends thereof facing one another across a connection gap extending between them from the connection opening. The connection bars are formed of a resilient material sufficiently resilient to allow the gap ends to be forced away from one another far enough to allow the pivot pin to pass between them to allow oblong object holder and any oblong object supported to be positioned in the first object retaining space.

12 Claims, 10 Drawing Sheets

U.S. PATENT DOCUMENTS

| | | | |
|---|---|---|---|
| 4,998,952 | A | 3/1991 | Hyatt, Jr. et al. |
| 5,003,801 | A | 4/1991 | Stinar et al. |
| 5,113,602 | A | 5/1992 | Levine et al. |
| 5,140,317 | A | 8/1992 | Hyatt, Jr. et al. |
| 5,177,989 | A | 1/1993 | Stillwagon |
| 5,215,190 | A | 6/1993 | Hoffpauir, Jr. |
| 5,245,329 | A | 9/1993 | Gokcebay |
| 5,365,760 | A | 11/1994 | Song |
| 5,768,924 | A | 6/1998 | Song |
| 5,943,889 | A | 8/1999 | Chiu |
| 6,038,130 | A | 3/2000 | Boeck et al. |
| 6,385,677 | B1 | 5/2002 | Yao |
| 6,522,534 | B1 | 2/2003 | Wu |
| 6,692,310 | B2 | 2/2004 | Zaderej et al. |
| 6,763,410 | B2 | 7/2004 | Yu |
| 6,808,400 | B2 | 10/2004 | Tu |
| 7,025,275 | B2 | 4/2006 | Huang et al. |
| 7,055,352 | B2 | 6/2006 | Meyerson et al. |
| 7,184,264 | B2 | 2/2007 | Le |
| 7,306,366 | B1 | 12/2007 | Camenzind et al. |
| 7,394,353 | B2 | 7/2008 | Schambeck et al. |
| 7,397,343 | B1 | 7/2008 | Gokcebay et al. |
| 7,466,556 | B2 | 12/2008 | Hiew et al. |
| 2003/0177798 | A1 | 9/2003 | Chodosh |
| 2005/0217327 | A1* | 10/2005 | Frias Frias et al. ..... 70/395 |
| 2006/0016231 | A1 | 1/2006 | Khounsombath et al. |
| 2006/0086163 | A1 | 4/2006 | Downes |
| 2006/0155439 | A1 | 7/2006 | Slawinski et al. |
| 2006/0223369 | A1 | 10/2006 | Zheng |
| 2006/0236465 | A1 | 10/2006 | Rivera |
| 2007/0050911 | A1* | 3/2007 | Elsener ..... 7/118 |
| 2010/0000885 | A1* | 1/2010 | Downes ..... 206/37.2 |

* cited by examiner

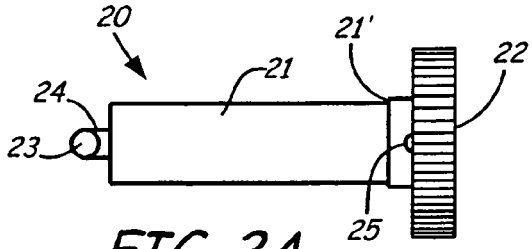
FIG. 2A
FIG. 2C
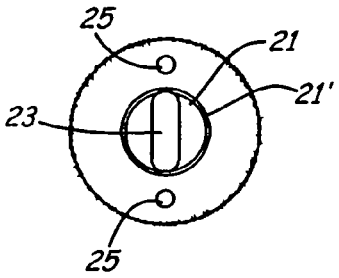
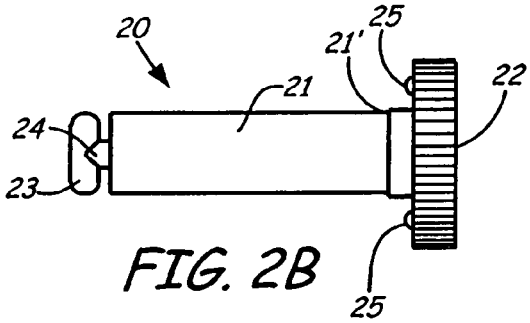
FIG. 2B
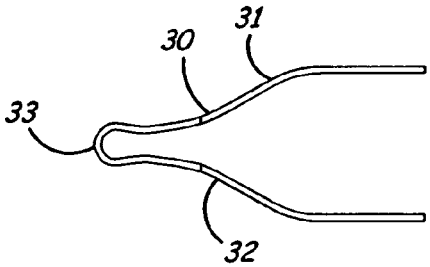
FIG. 3A
FIG. 3B
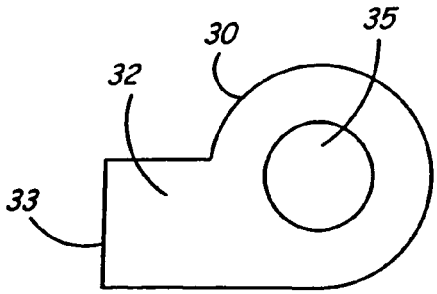

OBLONG OBJECT HOLDER

CROSS-REFERENCE TO RELATED APPLICATION(S)

This application claims the benefit of Provisional Patent Application No. 61/277,795 filed Sep. 30, 2009 for OBLONG OBJECT HOLDER, which is incorporated herein in its entirety by reference. This application is related to the following co-pending applications that are filed on even date herewith and are commonly owned: OBLONG OBJECT HOLDER, Ser. No. 12/924,598; and OBLONG OBJECT HOLDER, Ser. No. 12/924,597. The disclosures of these applications are incorporated herein by reference in their entirety.

BACKGROUND

The present invention relates to oblong object holders and, more particularly, to oblong object holders which have one end of the objects free while also being held at the other end thereof.

Many people have needs for keeping a variety of oblong objects with them as they go about their various daily activities, objects such as keys, nail files or other tools shaped oblong by handles or tool structures therein, electronic memory devices having electrical interconnections plugs at one end thereof, and the like. Carrying them about as individual, unconnected objects makes difficult finding them in a carrier's pocket or purse if there are several of such objects, especially with them having geometric outlines more or less similar to one another. Thus, people typically use some kind of organizing holder device to hold at least some of such carried about objects in some ordered arrangement.

A substantial variety of kinds of these holder devices are in current and past use. There are many kinds of key holders, for example, some having keys which swing out of the holder for use through rotating about a pivot of some sort, or about a ring, or swing with a ring that is somehow captured so as to allow that ring with the key to rotate. Other kinds of holders allow keys or other oblong objects to be slid in and out of the holder.

Many of these holders are formed from a multitude of parts of different materials and which must be individually assembled in fabricating the holder structure. Often, mounting the oblong objects to be held in the holder is inconvenient, or even difficult, and many allow holding therein only very limited numbers of objects. Similarly, the means for selecting objects from the holder to thereby become accessible for use is often inconvenient or difficult. Thus, there is a desire for an economical and convenient oblong object holder that can accommodate a variety of different oblong objects therein.

SUMMARY

The present invention provides a holder of oblong objects pivotably mounted therein so as to be selectively positionable and selectively retainable therein comprising a pair of oblong sidewall structures spaced apart across an object retaining space from one another each having a mounting side end across from one another with at least one of said pair of oblong structures having a sidewall opening at the mounting end thereof extending therethrough. A pivot pin is positionable in said sidewall opening, and also removable therefrom. An oblong object holder has a connection structure at a connection end thereof and supports a selected object to be held in the holder at an opposite support end thereof with the connection structure having a pair of connection bars each extending away from the support end and about an opposite side of a connection opening between them to result in gap ends thereof facing one another across a connection gap extending between them from the connection opening. The connection opening has opposite sides thereof separated by distances larger than distances across the pivot pin at the first object retaining space when the pivot pin is extending concurrently through the sidewall opening. The connection bars are formed of a resilient material sufficiently resilient to allow the gap ends to be forced away from one another far enough to allow the pivot pin to pass between them. The oblong object holder and any oblong object supported at the support end thereof are thin enough in a direction perpendicular to the direction of extent of the connection bars about the connection opening to be positioned in the first object retaining space.

BRIEF DESCRIPTION OF THE DRAWINGS

FIGS. 2A, 2B and 2C show three side views of a portion of the embodiment in FIG. 1 of the present invention, FIGS. 3A and 3B show top and side views of a portion of the embodiment in FIG. 1 of the present invention.

DETAILED DESCRIPTION

Figure 1:
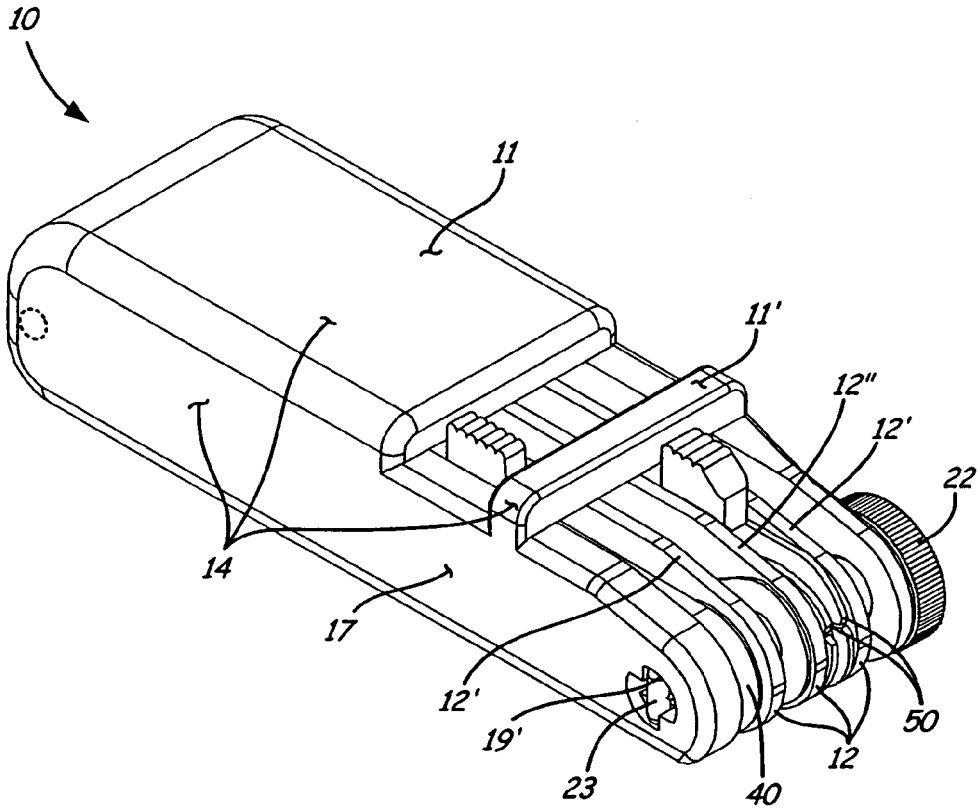
FIG. 1 shows an overhead perspective view of an embodiment of the present invention.
Figure 1A:
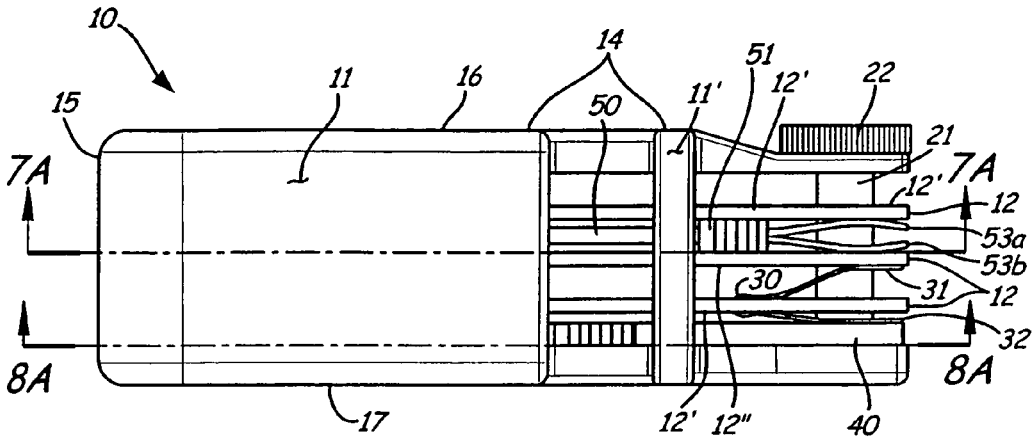
FIG. 1A shows a top view of the embodiment in FIG. 1 of the present invention.

FIG. 1 shows a perspective view of an example of the oblong object holder, 10, of the present invention, and FIG.

Figure 1B:
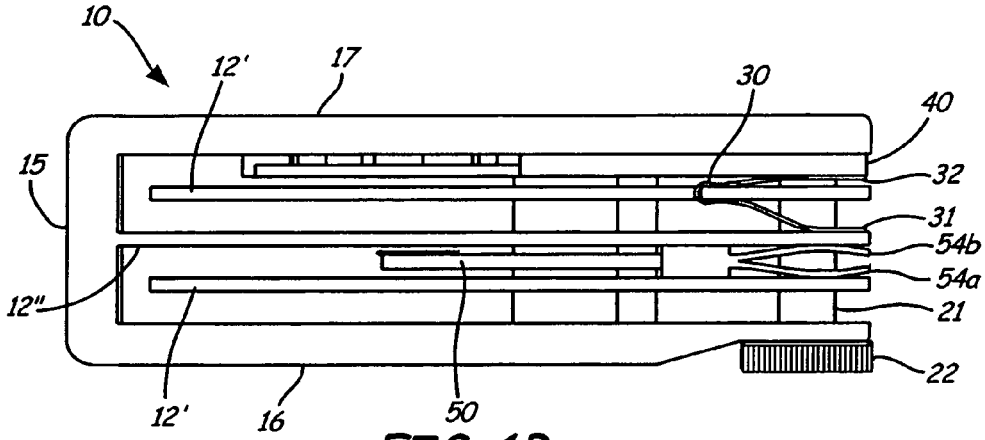
FIG. 1B shows a bottom view of the embodiment in FIG. 1 of the present invention.

1A shows a top view thereof with FIG. 1B showing a bottom view thereof. Holder 10 has a more or less rectangular solid shaped base plate, 11, with inner and outer major surfaces on either side thereof, and a base support dividing bar, 11', also an approximately rectangular solid with inner and outer major surfaces on either side thereof. Extending perpendicularly outward from the inner major surfaces of both base plate 11 and base support dividing bar 11', so as to extend parallel to one another, are the supported ends of a plurality of spaced apart separator slats, 12, and these slats also extend lengthwise perpendicularly past an exposed end edge of plate 11, and also past base support dividing bar 11' in cantilever fashion to thus have corresponding unsupported ends. Each of the unsupported separator slat ends has a circular opening, 13, extending therethrough, and all of them are coaxial with one another. Base plate 11, base support dividing bar 11' and separator slats 12 are portions of a housing, 14, typically formed of a somewhat resilient polyacetyl polymer or copolymer material.

In addition, in housing 14, there is an end side, 15, positioned at the enclosed end edge of plate 11, the edge opposite the exposed edge of plate 11. End side 15 perpendicularly joins two outer sides, 16 and 17, each positioned at a corresponding one of the remaining edges of plate 11, the side edges across plate 11 from one another. End side 15 and outer sides 16 and 17 also extend perpendicularly outward from the inner major surface of plate 11 at their base plate edge locations, and outer sides 16 and 17 also extend perpendicularly outward from the shorter sides of base support dividing bar 11'. Thus, base plate 11, end side 15, and dividing bar 11' each "bridge" across the space separating outer sides 16 and 17. Outer sides 16 and 17 also have unsupported ends extending parallel to the side edges of base plate 11, and so perpendicularly past the exposed end edge of plate 11, and also past base support dividing bar 11' in the same cantilever fashion followed by slats 12.

A dashed line circular opening is shown extending through side 17 of housing 14 in FIG. 1 near end side 15 as part of an alternative external device connecting arrangement which can be chosen to be or not be provided with holder 10. A similarly sized and positioned circular opening can then also extend through opposite side 16 across from the corresponding opening in side 17. Thus, a band or a ring or a chain can be inserted through both of these two openings to be used to attach a fob or other external object to holder 10. In a further addition or alternative, a ring-like structure extending outward from holder 10 can be formed integrally with, or attached to, the outer surface of end side 15 with the opening therethrough again through which a band or a ring or chain, or even a carabiner, can be inserted.

Separator slats 12 extend lengthwise perpendicular to end side 15, and have the supported ends thereof, located opposite the unsupported ends thereof, at the end side 15 region of base plate 11. Those two slats nearest outer sides 16 and 17, respectively, are spaced apart from end side 15. Those two of slats 12, and the further away slats in each of the succession of pairs of slats 12 between them in larger capacity holders than holder 10 shown, together form a group of positioning slats, 12', in the plurality of separator slats 12. Each of positioning slats 12' has between it and the next closest one thereto, or between it and each of the next closest ones thereto, another of the plurality of separator slats 12 not in the positioning slats group. The one such slat in holder 10 between two positioning slats 12', and all such slats between positioning slats in larger capacity holders than holder 10 shown, are joined to end side 15. These slats in the plurality of separator slats 12 that are each between a pair of positioning slats 12' form a group of structure slats, 12", in the plurality of separator slats 12.

Figure 1C:
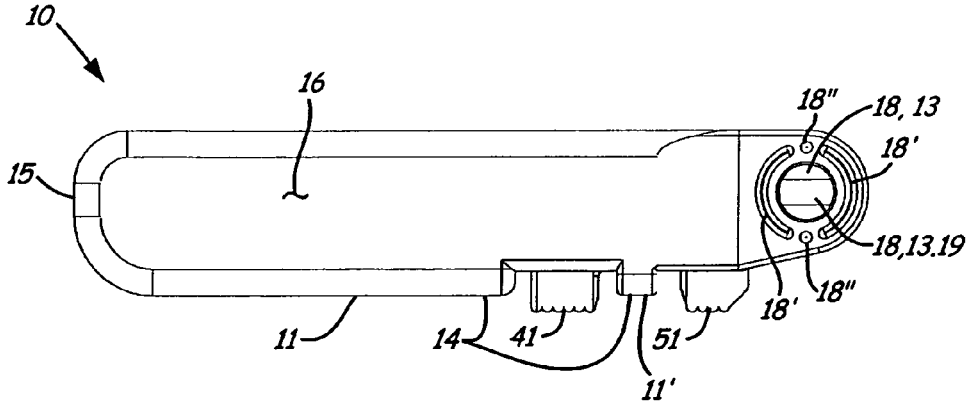
FIG. 1C shows a side view of a portion of the embodiment in FIG. 1 of the present invention.

The unsupported end of outer side 16 also has a circular entrance opening extending therethrough, 18, as can be seen in the partial disassembled side view of FIG. 1C (nothing shown in opening), that is coaxial with, and about the diameter of, circular slat openings 13. Outside, but concentric with opening 18, are two separated partial semicircular arc shaped recesses, 18', in outer side 16 with each having a cross section perpendicular to the surface of side 16 in the shape of half of a circular disk. Each of the recess semicircular arcs has the same radius but which is slightly larger than the radius of opening 18. Centered in each the separations between partial semicircular arc shaped recesses 18', at the same radial distance, is a hemispherical recess, 18".

Figure 1D:
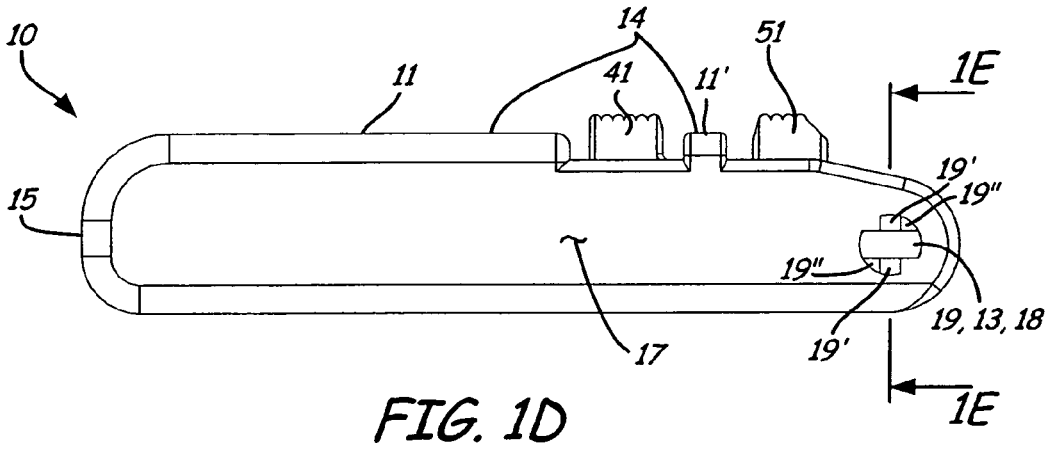
FIG. 1D shows another side view of a portion of the embodiment in FIG. 1 of the present invention.

A slot opening, 19, extending through the unsupported end of outer side 17, can be seen in the partial disassembly side view of FIG. 1D (nothing shown in opening). Opening 19 extends lengthwise parallel to a diameter of opening 13 in the separator slat 12 adjacent thereto, and of a similar length, with the center of this slot opening coinciding with the common axis of symmetry of coaxial openings 13. Slot opening 19 is shaped as a rectangular slot opening but extended by a pair of half circular cylinder slot end openings each extending from a corresponding one of the opposite shorter sides of the rectangular slot opening, i.e. the short ends of this slot opening appear as circular arcs in FIG. 1D. There is a similarly shaped detent recess, 19', in outer side 17 at the outer surface thereof having its center coinciding with that of slot opening 19 but with the primary length of recess 19' extending perpendicularly to the primary length of slot opening 19 and approximately equal thereto.

In FIG. 1C, the complete outer side-to-outer side opening extending through entrance opening 18, slat openings 13, and slot opening 19 is designated 18, 13, 19, and the opening extending through opening 18 and slat openings 13 to the inner surface of outer wall 17 is designated 18, 13. Similarly, in FIG. 1D, the complete outer side-to-outer side opening extending through slot opening 19, slat openings 13, and entrance opening 18 is designated 19, 13, 18.

Figure 1E:
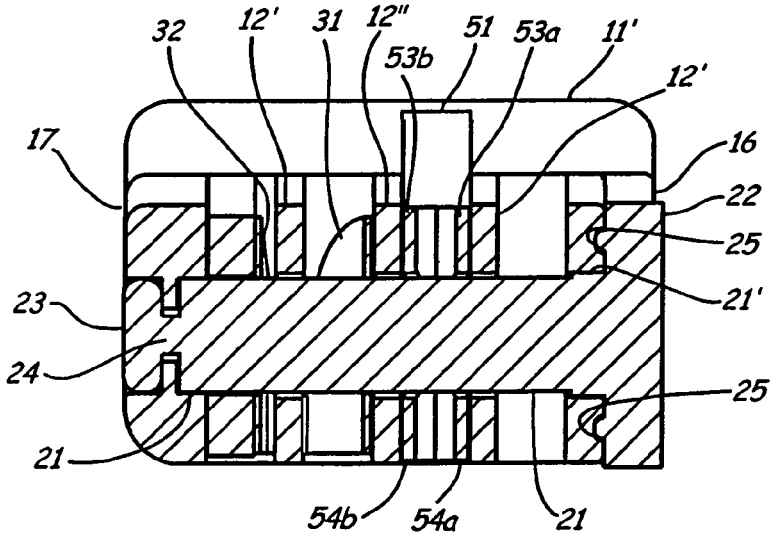
FIG. 1E shows a cross section view of a further side of the embodiment in FIG. 1 of the present invention.

In addition, there are two turning clearance section recesses, 19", in outer side 17 opposite one another each extending between an outer portion of slot opening 19 and an adjacent outer portion of detent recess 19', and not extending into outer side 17 as deeply as detent recess 19'. Thus, each turning clearance section recess 19" two joined perpendicular straight sides, one set by slot opening 19 and one set by detent recess 19', with the remaining ends joined by a circular arc with a radius equal to half the length of opening 19. There further is a circular shaped recess at the inner surface of outer side 17 so as to effectively leave a reduced thickness integral wall structure about slot opening 19. Outer side openings 19 and 18 are further indicated in an end side cross section view in FIG. 1E.

A locking pin, 20, is provided for extending through openings 18, 13 and 19 to capture and hold oblong objects, such as keys, having capture openings in them through which pin 20 can also extend, and shown in the three side views of FIGS. 2A, 2B and 2C. Locking pin 20 has a main circular cylindrical shaft, 21, and has one end thereof ringed with a slightly greater diameter ring strip, 21', thereabout that, nevertheless, has a diameter slightly less than that of opening 18 in outer side 16 into which it will be inserted during use. This ringed end 21' of main shaft 21 is attached to a disk shaped, outer edge knurled, knob, 22, having a diameter larger than that of shaft 21 and ring strip 21'.

The length of shaft 21 is sufficient to have the opposite end thereof extend into the circular shaped recess at the inner surface of outer side 17 to thereby support that end of the shaft in side 17. The opposite end of shaft 21 is also attached to a locking bar, 23, extending in length parallel to a diameter of main shaft 21. Locking bar 23 is attached to main shaft 21 by a reduced diameter circular cylindrical subshaft, 24, having its axis of symmetry coaxial with the axis of symmetry of main shaft 21. The length of locking bar 23 is just slightly less than the length of slot opening 19 and of detent recess 19', and the length of subshaft 24 is just slightly less than the thickness of the material in outer wall 17 at sector recesses 19". The support provided by side 17 to shaft 21, because of extension of shaft 21 into the circular shaped recess at the inner surface of outer side 17, aids in isolating locking bar 23 and subshaft 24 from lateral forces that they would be less able than shaft 21 to withstand because of their smaller cross sectional dimensions. However, in some alternatives, this circular shaped recess at the inner surface of outer side 17 can be omitted with one such alternative being the omission of locking bar 23 and provision of screw threads on subshaft 24 and along the surface of an interior opening in outer side 17, extending therein from the inner surface of side 17. This latter arrangement thereby allows locking pin 20 to extend through outer side 16 to be screwed into outer side 17.

Two hemispherical protrusions, 25, extend toward locking bar 23 from the interior disk surface of knurled knob 22 at a radius from the axis of symmetry of shaft 21 equal to the radius to the positions of hemispherical recesses 18" in the outer surface of outer side 16. The radii of protrusions 25 are slightly less than the radii of recesses 18" and also slightly less than the radii of the cross section half circular disks partial semicircular arc shaped recesses 18'. Locking pin 20 is typically formed of a relatively stiff polyamide polymer such as nylon.

An object restraining spring, 30, is mounted about the unsupported end of a corresponding slat 12' with this spring having two bar and lobe side structures, 31 and 32, with a constrained end and a free end extending away from the constrained end in the direction of the slat, and so the outer side, free ends are thus at opposite ends of the spring. Hence, one free end of the spring provides a spring force directed at structure slat 12", and the other free end thereof provides a spring force directed at side 17.

This spring is shown in the side and top views of FIGS. 3A and 3B. Restraining spring 30 also has a short side structure, 33, joining together the two bar and lobe structures therein at the constrained ends of each and which is positioned in a notch, 34, in the edge facing away from base plate 11 of the one of slats 12' about which it is mounted. Openings, 35, are provided in the free ends of restraining springs 30 such that they are aligned with slat openings 13 and outer end openings 18 and 19. Object restraining spring 30 is typically formed of a suitable spring steel such that lobes 31 and 32 thereof resiliently press against structure slat 12", the inner surface of side 17, or against an oblong object captured in holder 10 adjacent such a spring lobe.

Figure 4A:
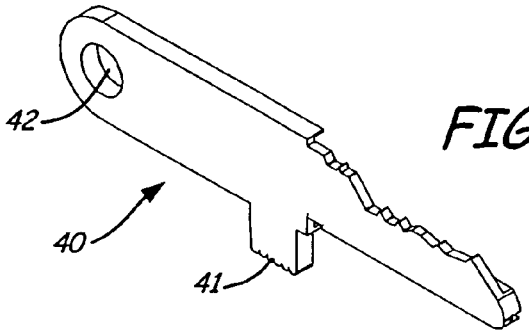
FIGS. 4A, 4B and 4C show a perspective and two side views of an oblong object for being held in the embodiment in FIG. 1 of the present invention.
Figure 4B:
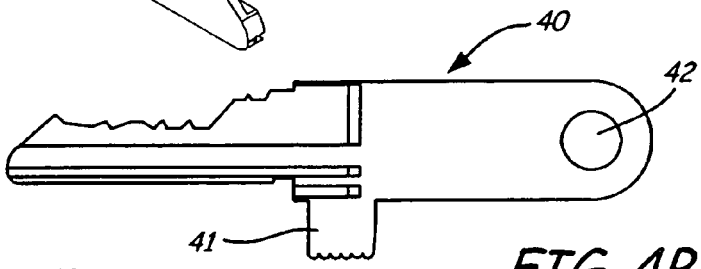
Figure 4C:
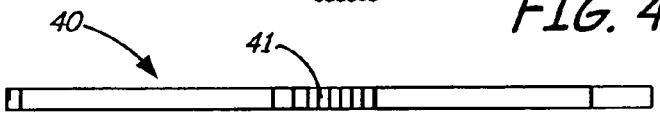

FIG. 4A shows a perspective view of an example of one kind of oblong object, 40, a custom shaped key, that is to be captured in holder 10, and there, to have a free end thereof be rotatably accessible through being forced outside of that holder for use purposes. That is, key 40 can be selectively forced outside of holder 10 by a user through that user pushing on a push bar, 41, formed as part of key 40 so as to not have to be any thicker than the remainder of that key thereby allowing less spacing apart of the slats 12 or one such slat and side between which the key will carried in holder 10. The side views of key 40 in FIGS. 4B and 4C show more clearly the relative positions of the key teeth and push bar 41, and also of a circular capture opening, 42, formed in key 40 at the opposite end thereof from the key teeth. Holder 10 can be structured to hold only keys arranged like key 40.

Figure 5A:
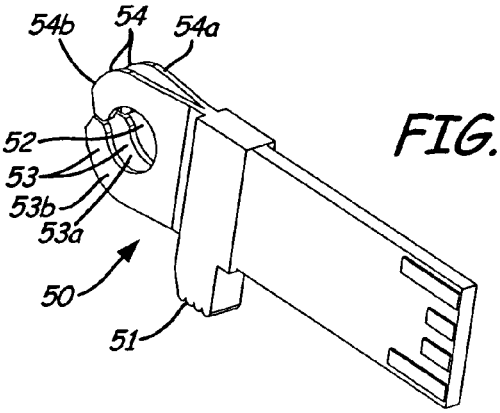
FIGS. 5A, 5B and 5C show a perspective and two side views of another oblong object for being held in the embodiment in FIG. 1 of the present invention.
Figure 5B:
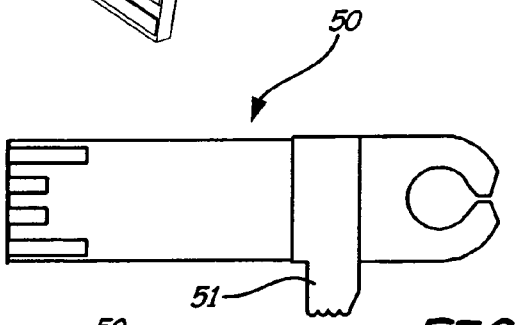
Figure 5C:
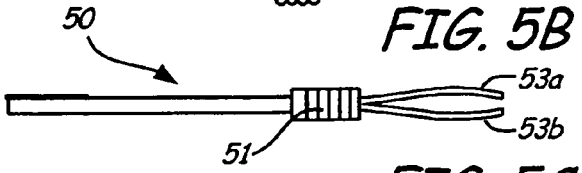

FIG. 5A shows a perspective view of another example of a kind of oblong object, 50, a custom shaped electronic component, or device, and an electrical connector in a joint structural arrangement, and that is also to be captured in holder 10. Again, once so captured, the free end thereof with the electrical connector is to be rotatably accessible through being forced outside of that holder for use purposes. As for key 40, the electrical connector end of joint component structural arrangement 50 can be selectively forced outside of holder 10 by a user through that user pushing on a push bar, 51, this bar formed as part of arrangement 50 so as to not have to be any thicker than the remainder of that arrangement. Two side views of arrangement 50 in FIGS. 5B and 5C show more clearly the relative positions of the electrical connector with the electronic component or device encapsulated behind it and push bar 51 somewhat further behind, and also of a circular capture opening, 52, formed in arrangement 50 at the opposite end of the arrangement from the connector by a pair of joint arrangement springs, 53 and 54, each partially surrounding that opening.

Joint arrangement springs 53 and 54 each extend outward from push bar 51 on opposite sides of capture opening 52 to nearly meet at their free ends on the far side of that opening but with a tapered sides spatial gap remaining between those free ends. Each of these springs diverge at their free ends into a pair of approximately semicircular flat "half ring" shaped resilient spring sides affixed in the arrangement at their constrained ends to, or near to, push bar 51. In the figures, joint arrangement springs 53 and 54 have the spring pair member therein nearest outer side 16 designated an "a" spring and the other pair member has been designated a "b" spring. In addition, they have their joint arrangement spring designations 53 and 54 so that the designations shown for these springs are 53*a*, 53*b*, 54*a* and 54*b*.

Figure 5D:
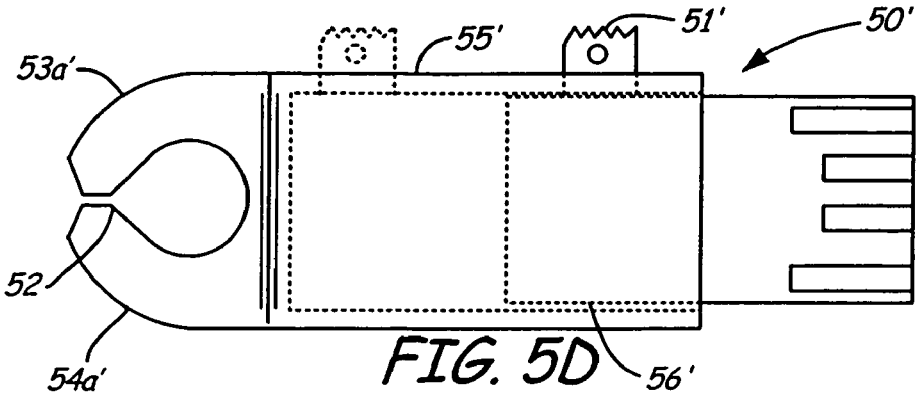
FIG. 5D shows a side view of yet another oblong object for being held in the embodiment in FIG. 1 of the present invention that is a variant of the oblong object shown in FIGS. 5A, 5B and 5C, FIGS. 6A, 6B and 6C show a perspective view and side views of portions of FIGS. 5 and 2A in a procedural sequence.

FIG. 5D shows a side view of another example of a kind of oblong object, 50', that is a variant of the joint structural arrangement shown in FIGS. 5A, 5B and 5C again with a custom shaped electronic component, or device, that can be partially ejected from a substantially surrounding protective housing, and an electrical connector that is again to be captured in holder 10. Again, once so captured, the free end thereof with the electrical connector is to be rotatably accessible through being forced outside of that holder for use purposes. As for joint component structural arrangement 50, the electrical connector end of joint component structural arrangement 50' can be selectively forced outside of holder 10 by a user through that user pushing on a push bar, 51'. A pair of joint arrangement springs, 53' and 54', like joint arrangement springs 53 and 54 in joint component structural arrangement 50, each extend outward, but here, from a component housing, 55'. Corresponding semicircular flat "half ring" shaped resilient spring sides 53*a*' and 54*a*' are seen in the side view of FIG. 5D.

Push bar 51' is formed as part of an integrated electronic component, or device, 56', and electrical connector, 57', arrangement. This integrated component and connector arrangement is slidably encased in housing 55' to protect it from damage due to the possibility of its coming into unwanted contact with some outside body except for the push bar portion thereof extending through a slot in the side of this housing. Push bar 51' can then be pushed toward the opposite side of holder 10 to selectively force the electrical connector end of joint component structural arrangement 50' outside of holder 10, but can also be slid outwardly and back to partially eject integrated component 56' and connector 57' arrangement outside of housing 55' for use in being mated with a compatible female connector portion, and to retract same into the interior of housing 55'.

The electrical connector in joint component structural arrangement 50, and connector 57' in joint component structural arrangement 50', are for the connecting of the electronic component or device in the arrangement, as a peripheral device of some sort, into some kind of a computer based network. This connector is shown as a Universal Serial Bus (USB) connector formed so as to meet the corresponding standard specifications therefor, but other kinds of connectors meeting different specifications could alternatively be used if needed instead to mate to the computer network or to other devices in such a network. The electronic component or device that is encapsulated in a suitable polymer in arrangement 50 and interconnected with the electrical connector would typically be a digital data memory device or an encryption code access device, but could any of many other kinds of electronic or electrical devices. Holder 10 can be structured to hold only oblong objects arranged like oblong object 50 or only a mixture of objects arranged like oblong object 50 and keys arranged like key 40.

Base support dividing bar 11' can be seen in FIGS. 1 and 1D to divide the space between push bar 41 in key 40 and push bar 51 in joint component structural arrangement 50 as assembled in housing 14 of holder 10, and aids in preventing items passing across these push bars from snagging them (though this dividing bar is not required to be present in holder 10). Last described push bar 51 nearer locking pin 20 also has a chamfer beginning at its outermost surface angled toward the opposite end thereof to further aid in its avoiding any snagging of interior material surfaces passing thereby as may occur with any containing arrangement into which holder 10 is inserted such as a pocket or a purse.

Capturing an oblong object such as key 40 in holder 10 starts by positioning that key between one of the outer sides 16 and 17 and an adjacent separator slat 12, as shown in the example of FIG. 1, or between two adjacent separator slats 12, and with the key capture opening provided in key 40 substantially coaxially aligned with slat openings 13, restraining spring openings 35, and outer end openings 18 and 19. The locking bar 23 end of locking pin 20 is then inserted through outer side entrance opening 18, slat 12 openings 13 and the key capture opening, and finally through outer side slot opening 19. Insertion of locking bar 23 through slot opening 19 requires that bar 23 be aligned with slot opening 19 which will also result in hemispherical protrusions 25 each being in a corresponding one of the two separated partial semicircular shaped recesses 18' in outer side 16. Knurled knob 22 is then rotated to thereby rotate main shaft 21 and locking bar 23 to result in locking bar 23 being positioned in detent recess 19' to thereby restrain locking pin 20 to remain in that position and capture the key in holder 10, and concurrently results in hemispherical protrusions 25 extending inward from knob 22 each being in a corresponding one of the two hemispherical recesses 18".

Capturing joint component structural arrangement 50 in holder 10 can be done similarly to key 40 by positioning arrangement 50 between two adjacent separator slats 12, as shown in the example of FIG. 1, or between one of the outer sides 16 and 17 and an adjacent separator slat 12, and with the capture opening provided in arrangement 50 substantially coaxially aligned with slat openings 13, restraining spring openings 35, and outer end openings 18 and 19. Using this method, the tapered sides spatial gap between the free ends of joint arrangement springs 53 and 54 in arrangement 50 could be eliminated so that the previously free ends in each spring would be joined to result in the spring having a ring configuration.

Figure 6A:
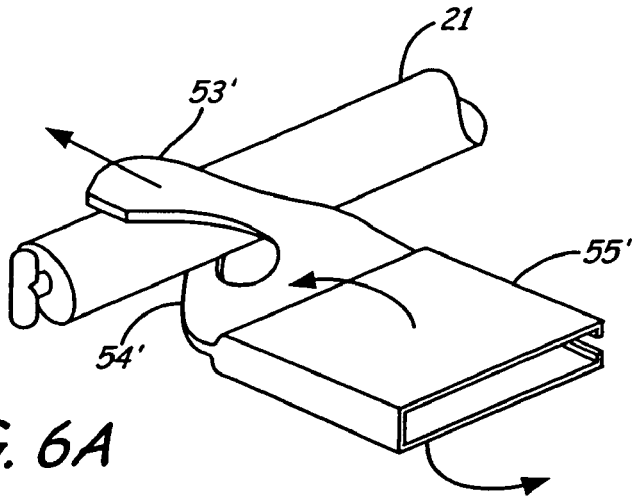
Figure 6B:
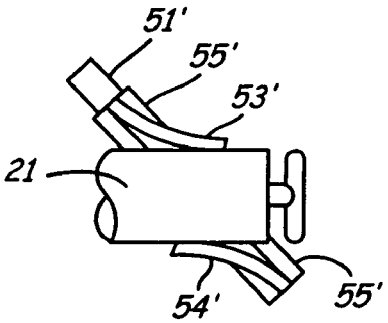
Figure 6C:
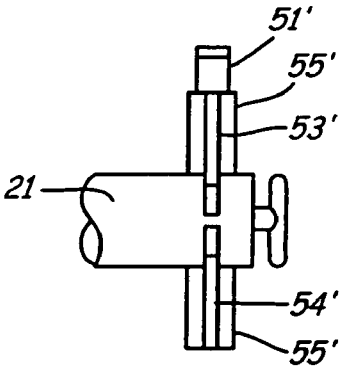

However, the flexibility of joint arrangement springs 53 and 54 in arrangement 50 because of being resilient, and the presence of this spatial gap between their free ends, allows another alternative for capturing this arrangement about locking pin 20 in holder 10 after that pin has been restrained in holder 10 by rotating knob 22, as may have been done previously as part of capturing some other oblong object earlier in that holder. Thus, for joint component structural arrangement 50' as an example shown in FIGS. 6A, 6B and 6C (same procedure also for joint component structural arrangement 50), positioning the spatial gap provided between joint arrangement springs 53' and 54' against main shaft 21 of locking pin 20 between slats 12, or between a slat and a holder side (slats, or slat and holder, not shown), and then turning housing 55' will twist the ends of those springs against that shaft. This will squeeze together the semicircular flat "half ring" shaped resilient spring sides in those springs and cause the springs to deflect to opposite sides of shaft 21 as seen in FIG. 6A. Then the free ends of those springs can be forced by pushing on housing 55' to pass by that shaft as seen in FIG. 6B to, after reversing the turn of housing 55', thereby leave shaft 21 in capture opening 52 with springs 53' and 54' thereabout. Arrangement 50', so captured, can also be removed by turning and pulling on it sufficiently to deflect springs 53' and 54' to thereby force the free ends thereof to pass by main shaft 21 to free that arrangement from holder 10.

Figure 7A:
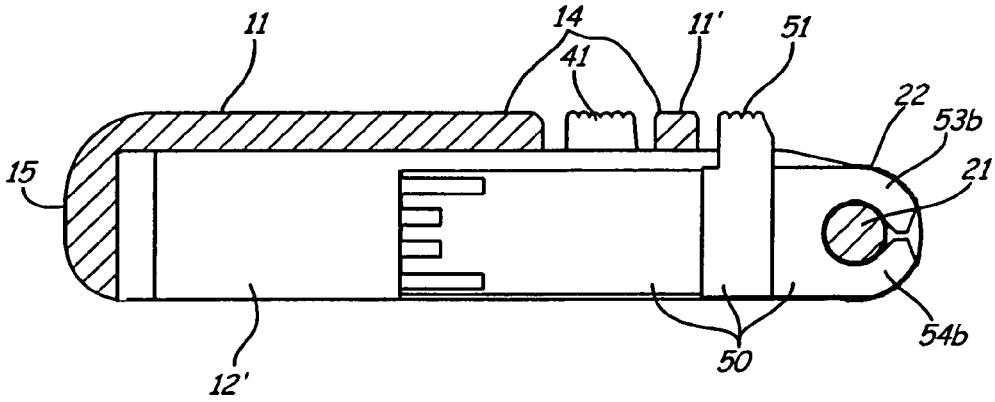
FIGS. 7A and 7B show side cross section views of the embodiment in FIG. 1 of the present invention.
Figure 7B:
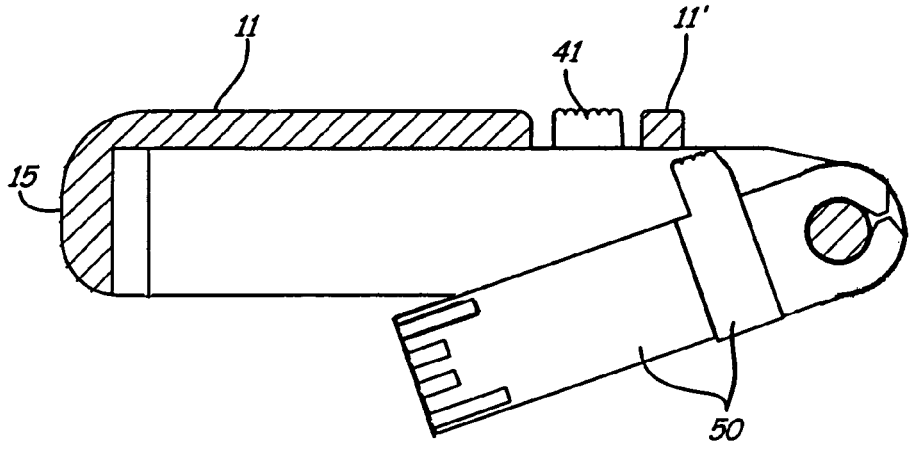

Positioning captured joint component structural arrangement 50 for use once it has been captured on locking pin 20 is indicated in the side cross section views of FIGS. 7A and 7B, and merely requires the pushing inward into housing 14, to a location at or inside of dividing bar 11', the corresponding push bar 51 on arrangement 50. This pushing is against the frictional force that results from joint arrangement springs 53 and 54, in that space between those of slats 12 between which arrangement 50 has been captured, resiliently pressing against such adjacent ones of slats 12. Push bar 51, being pushed, thereby forces arrangement 50 to rotate about main shaft 21 of locking bar 20 against the joint arrangement springs supplied frictional force to thereby be partially outside of housing 14 from where it can easily be rotated further, or forced into a mating USB connector, or both. Arrangement 50 can thereafter be withdrawn and rotated about locking pin 20 by pushing on the exposed portion thereof to force it against the joint arrangement springs supplied frictional force back into housing 14 to be entirely within the space between the two adjacent ones of slats 12 (There is similar positioning of captured joint component structural arrangement 50' for use once it has been captured on locking pin 20 but push bar 51' must also be slid outwardly to partially eject connector 57').

Figure 8A:
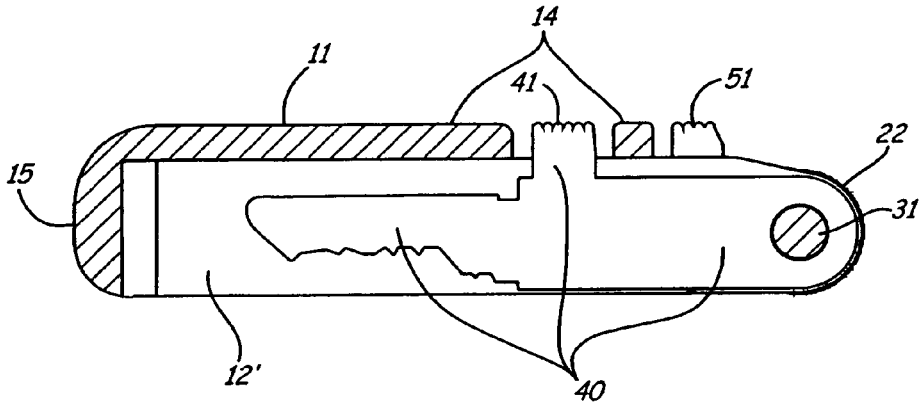
FIGS. 8A shows side cross section view and FIG. 8B shows a side view of the embodiment in FIG. 1 of the present invention.
Figure 8B:
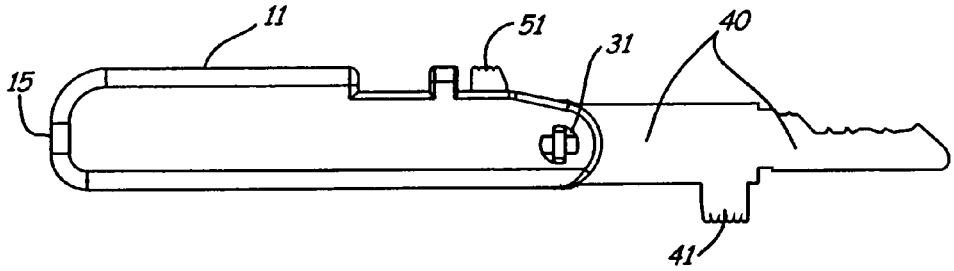

Similarly, positioning captured key 40 for use once it has been captured on locking pin 20 is indicated in the side cross section views of FIGS. 8A and 8B, and merely requires the pushing inward into housing 14, to a location at or inside of dividing bar 11', push bar 41. This pushing is against the frictional force that results from the adjacent one of lobes 31 or 32 of restraining spring 30 resiliently pressing against key 40. Push bar 41, being pushed, thereby forces key 40 to rotate about main shaft 21 of locking bar 20 against the restraining spring supplied frictional force to thereby be partially outside of housing 14 from where it can easily be rotated further, or forced into a keyhole of a lock, or both. Once holder 10 is rotated with key 40 in a keyhole of a lock to thereby unlock that lock, key 40 can be then withdrawn and rotated about locking pin 20 by pushing on the exposed portion of key 40 to force it against the restraining spring supplied frictional force back into housing 14 to be entirely within the space between slat 12 and outer side 17. The distance from the inside surface of base plate 11 where slat 12' is joined thereto across that slat to its opposite side need be no more than a) the greatest width of either joint component structural arrangement 50 in FIG. 7A or key 40 in FIG. 8A parallel to that distance to keep either protected when both are fully positioned within holder 10, or b) the greatest width of one of them if that one is the only type being protected in holder 10.

The resiliency of housing 14 and spring 30 limits the torque to a degree which the user, through rotating holder 10, can apply to key 40 to thereby reduce the risk of the user's force breaking the extended portion of that key from its base. The resiliency of housing 14 is due to the polymer material of which it is constructed, a material that also reduces accumulations of, and transfers of, static electricity in that housing and similarly in joint component structural arrangement 50.

Lengthening the slats and outer sides of holder 10 in FIG. 1 past the location of end side 15, after eliminating that side, allows forming a second end object capture structure in the holder for the capture of a further set of oblong objects. The resulting holder needs to be longer than the sum of the lengths of the oblong objects that are in the same spaces between slats or between slats and sides captured at opposite holder ends. One example of such a holder, 10', is shown in the overhead perspective view of FIG. 9. The object capture structure in holder 10 at the end thereof matching that shown in FIG. 1, used for the capture there of a set of oblong objects therein, retains the same numerical designations for the corresponding capture structure in holder 10' in FIG. 9 as were used therefor in FIG. 1. Similar numerical designations are used for the other capture structure at the opposite end of holder 10' in FIG. 9 but with a letter "a" added thereto.

Key 40 that is captured in holder 10 in the FIG. 1 arrangement is captured instead as key 40*a* at the added end of holder 10' and modified there by removing push bar 41 therefrom. Otherwise the capture structure in holder 10' in which joint component structural arrangement 50 is captured is in holder 10' as described for holder 10 in the arrangement of FIG. 1.

Figure 9:
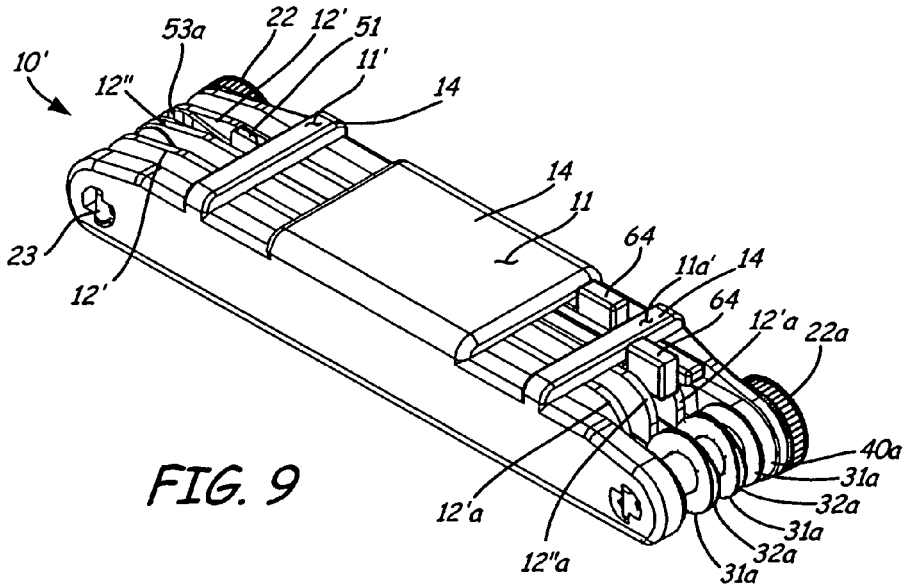
FIG. 9 shows an overhead perspective view of another embodiment of the present invention.
Figure 9A:
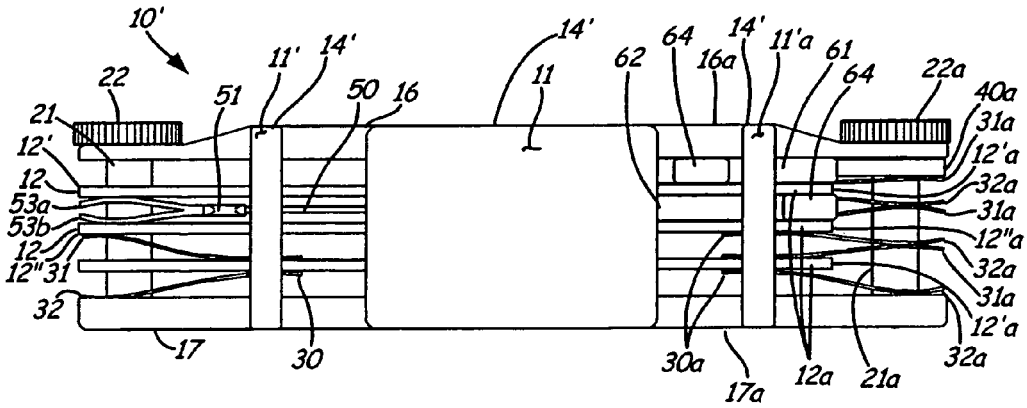
FIG. 9A shows a top view of the embodiment in FIG. 9 of the present invention.
Figure 9B:
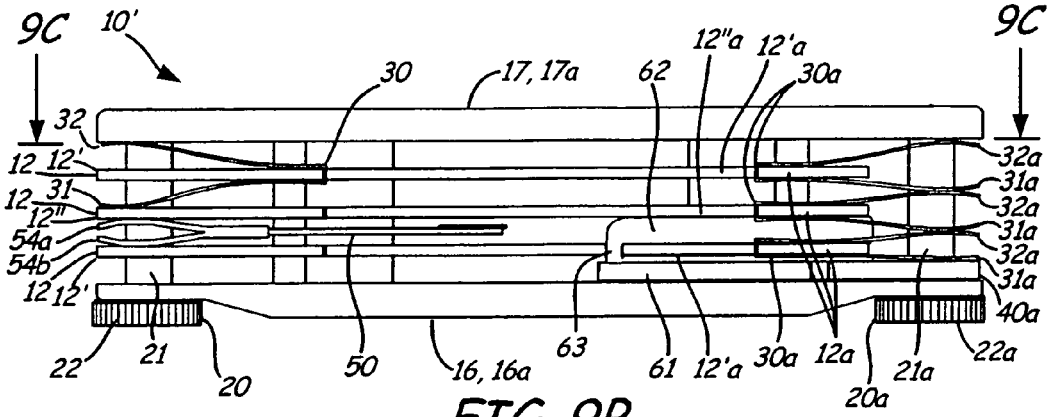
FIG. 9B shows a bottom view of the embodiment in FIG. 9 of the present invention.

The capture structure at the opposite end of holder 10' is shown in FIG. 9, and in the top and bottom views thereof in FIGS. 9A and 9B, respectively. Here, the unsupported separator slat ends of the plurality of separator slats 12 in the embodiment shown in FIG. 1, the group of positioning slats 12' and the structure slat 12" that have openings 13 therein to accommodate locking pin 20*a*, are replaced by a different plurality of separator slats, 12*a*. Separator slats 12*a* again has a group of positioning slats 12'a and the structure slat 12"*a*, but none of the unsupported ends thereof extends to locking pin 20*a* and so each of those slat ends has no opening therein to accommodate inserting that pin therethrough.

Figure 9C:
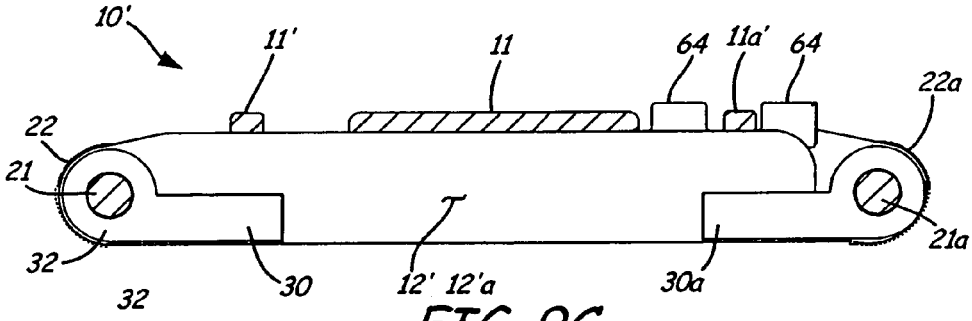
FIGS. 9C shows a side cross section view of the embodiment in FIG. 9 of the present invention.

Instead, an additional restraining spring 30*a* is mounted on and about a small portion of that structure slat 12'a not having one thereon in the FIG. 1 arrangement as is further seen in the side cross section view of FIG. 9C, and yet a further restraining spring 30*a* is mounted on and about a small portion of structure slat 12" a between the other two restraining springs as seen in the bottom view of FIG. 9B. These additional restraining springs each provide two additional object restraining surfaces which will press against oblong objects captured in the holder to frictionally restrain rotations thereof. Thus, there are somewhat different capture structures shown at the opposite ends of holder 10', and the differing types of capture arrangement combinations therein, and various others, can be more or less substituted for one another at the capture structure ends of the holders. (Alternatively, restraining springs 30*a* could be removed and slats 12*a* extended to have their ends about locking pin shaft 21*a*, as the outer ends of slats 12 are about locking pin shaft 21, and then have these ends split into dual ends by separating them with a slit in each slat between the major sides thereof along its length to result in the split ends being lateral force springs each providing a lateral force in a direction opposite the other along the length of shaft 21*a*.)

In this alternative configuration, a housing, 14', now includes base plate 11 and base support dividing bar 11' along with a second base support dividing bar 11'*a* on the opposite side of base plate 11. Base plate 11 and dividing bar 11' are each joined to slats 12, and base plate 11 and dividing bar 11'*a* are each joined with slats 12*a* in housing 14'. Each slat structure has corresponding integral portions representing a slat 12 and a slat 12*a* which are designated 12, 12*a* in the figures. Base plate 11 and dividing bar 11' are each joined to outer sides 16 and 17, and base plate 11 and dividing bar 11'*a* are each joined with outer sides 16*a* and 17*a* in housing 14". Each of these sides has corresponding integral portions representing, in one instance, a side 16 and a side 16*a* which is designated 16, 16*a* in the figures, and in another instance, a side 17 and a side 17*a* which is designated 17, 17*a* in the figures.

Figure 10A:
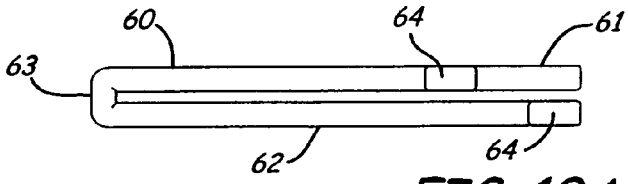
FIGS. 10A and 10B show top and side views of a portion of the embodiment in FIG. 9 of the present invention.
Figure 10B:
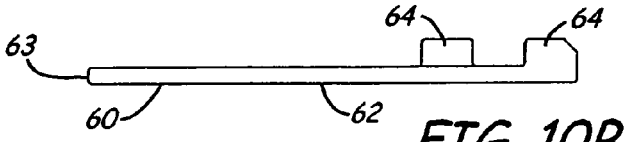

In connection with the elimination of a push bar from key 40*a*, as indicated above, an alternative arrangement is provided for forcing the end of key 40*a* outside of holder 10'. A relatively resilient material U-shaped ejection member, 60, shown in the top and side views of FIGS. 10A and 10B, is provided in housing 14'. Ejection member 60 has two long side structures, 61 and 62, with each of those having a free end and a constrained end as opposite ends thereof. Structures 61 and 62 are positioned on either side of a corresponding positioning slat 12'*a*. Ejection member 60 also has a short side structure, 63, joining together the two long side structures therein at the constrained ends of each. This short side structure provides the constraining of the ends of the two long side structures 61 and 62 by joining together, and is shown positioned in a notch through the corresponding positioning slat 12'*a* in the holder bottom view in FIG. 9B. Portions of long side structures 61 and 62 in ejection member 60, and short side structure 63 thereof, are also positioned against the inner surfaces of base plate 11 and base support dividing bar 11'*a*. (Short side structure 63 could be eliminated and the ends of resulting separated long side structures 61 and 62, formerly connected to short side structure 63, each instead suitably affixed to housing 14' such as by adhering them to the inner surface of base plate 11.)

The remaining portions of long side structures 61 and 62 have the free ends thereof extend past the exposed edge of base plate 11 and further past base support dividing bar 11'*a*. Ejection member 60 typically is formed of either a resilient polyacetyl polymer or copolymer material or a resilient polyamide polymer such as nylon.

There is, in addition in ejection member 60, two push bars, 64, each extending perpendicularly outward to and past the outer surface of base plate 11 from relatively near the free ends thereof and from the side of each of the two long side structures in that ejection member facing base support dividing bar 11'*a*. That is, there is a pair of push bars 64 provided for ejection member 60, each extending from a corresponding one of long side structures 61 and 62. One of push bars 64 in the pair thereof in ejection member 60 extends from long side structure 61 in that member on the base plate 11 side of base support dividing bar 11'*a* relatively far from the free end of that long side structure, and the other of push bars 64 in the pair extends from long side structure 62 in that member on the opposite side of base support dividing bar 11'*a* relatively near the free end of that long side structure. Thus, base support dividing bar 11'*a* divides the space between push bars 64 in ejection member 60 as assembled in housing 14' of holder 10', and aids in preventing items passing across these bars from snagging them.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A holder of oblong objects pivotably mounted therein so as to be selectively positionable and selectively retainable therein, said holder comprising:

a first pair of oblong sidewall structures spaced apart across a first object retaining space from one another each having a mounting end with a sidewall opening therethrough such that said sidewall openings are also across from one another, a second pair of oblong sidewall structure pairs spaced apart across a second object retaining space from one another and each having a mounting side end across from one another with each mounting side end having a sidewall opening therethrough such that said sidewall openings are also across from one another, there being a separator sidewall structure in said second pair of oblong sidewall structures having an opposite end thereof joined with an end support wall and an accommodating sidewall structure therein having an opposite end thereof spaced apart from said end support wall by an ejector space, said separator sidewall structure in said second pair of oblong sidewall structures being spaced apart from a nearest oblong wall structure in said first pair of oblong sidewall structures by a corresponding object retaining space, a restraining spring formed of a resilient sheet curved sufficiently to form a joined spring end with a pair of spring sides across from one another each extending away from said joined spring end to each have a free end across from one another with each free end having a spring opening therethrough such that said spring openings arc also across from one another, said restraining spring supported on said mounting side end of a supporting one of said sidewall structures in said second pair thereof such that said spring openings therein are each across from said sidewall opening in said supporting sidewall structure on either side thereof, an ejector mounted in said holder to be positioned in said second and said corresponding object retaining spaces at an ejector side of those said object retaining spaces to extend between said second pair of spaced apart oblong sidewall structures with said ejector formed of a resilient material such that an end thereof can be forced further into said object retaining space and thereafter return to said ejector side when said forcing ceases, a pivot pin positionable concurrently through each of said sidewall openings and said spring openings, and also removable therefrom, and an oblong object holder having a connection structure at a connection end thereof and supporting a selected object to be held in said holder at an opposite support end thereof, said connection structure having a pair of connection bars each extending away from said support end and about an opposite side of a connection opening between them to result in gap ends thereof facing one another across a connection gap extending between them from said connection opening, said connection opening having opposite sides thereof separated by distances larger than distances across said pivot pin at said first and said corresponding object retaining spaces when said pivot pin is extending concurrently through each of said sidewall openings and said spring openings, said connection bars formed of a resilient material sufficiently resilient to allow said gap ends to be forced away from one another far enough to allow said pivot pin to pass between them, said oblong object holder and any oblong object supported at said support end thereof being thin enough in a direction perpendicular to the direction of extent of said connection bars about said connection opening to be positioned in at least one of said first and said corresponding object retaining spaces.

2. The device of claim 1 wherein said ejector is curved sufficiently to form a joined ejector end thereof with a pair of ejector sides across from one another each extending away from said joined ejector end to each have a free end across from one another, said ejector being mounted in said holder with said joined end thereof in said ejector space to have one of said first ejector sides positioned in said second object retaining space at an ejector side of said first object retaining space to extend between said second pair of sidewall structures and to have that remaining one of said ejector sides positioned in said corresponding object retaining space at an ejector side thereof to extend between first sidewall structure pair and said separator sidewall structure in said second sidewall structure pair.

3. The device of claim 2 wherein at least a portion of a said ejector space is formed by a recess in said end wall support.

4. The device of claim 3 wherein a said joined ejector end of a said ejector is at least partially in said recess in said end wall support.

5. The device of claim 4 wherein said joined ejector end of said ejector at least partially in said recess in said end wall support is constrained toward remaining there by a side of said recess pressing on said joined ejector end of said ejector.

6. The device of claim 2 further comprising said oblong sidewall structures of said first and second pairs of oblong sidewall structures being further joined by a dividing bar near said mounting side ends thereof adjacent said ejector with said ejector having an ejector button extending outward from each of said ejector sides thereof to be alongside said dividing bar such that said ejector buttons on said ejector sides of said ejector are on alternate sides of said dividing bar.

7. The device of claim 2 wherein said oblong object holder has a connector button on said connection structure between said connection bars and said supported object extending outward from said connection structure to be alongside said dividing bar.

8. The device of claim 1 wherein said supported object comprises a Universal Serial Bus USB connector and an electronic circuit component.

9. A holder of oblong objects pivotably mounted therein so as to be selectively positionable and selectively retainable therein said holder comprising: a pair of oblong sidewall structures spaced apart across an object retaining space from one another each having a mounting side end across from one another with at least one of said pair of oblong structures having a sidewall opening at said mounting end thereof extending therethrough, a pivot pin positionable in said sidewall opening, and also removable therefrom, and an oblong object holder having a connection structure at a connection end thereof and supporting a selected object to be held in said holder at an opposite support end thereof, said connection structure having a pair of connection bars each extending away from said support end and about an opposite side of a connection opening between them to result in gap ends thereof facing one another across a connection gap extending between them from said connection opening, said connection opening having opposite sides thereof separated by distances larger than distances across said pivot pin at said object retaining space when said pivot pin is extending concurrently through said sidewall opening, said connection bars formed of a resilient material sufficiently resilient to allow said gap ends to be forced away from one another far enough to allow said pivot pin to pass between them, said oblong object holder and any oblong object supported at said support end thereof being thin enough in a direction perpendicular to the direction of extent of said connection bars about said connection opening to be positioned in said first object retaining space, wherein said pair of sidewall structures is a first pair of sidewall structures and said object retaining space is a first object retaining space and further comprising a plurality of sidewall structure pairs each formed of a pair of oblong sidewall structures spaced apart across an object retaining space from one another and each having a mounting side end across from one another, there being a separator sidewall structure in each sidewall structure pair and an accommodating sidewall structure therein, said separator sidewall structure in each of said plurality of sidewall structure pairs being spaced apart from said accommodating sidewall structure in an adjacent sidewall structure pair, including a nearest sidewall structure in said first sidewall structure pair as an accommodating sidewall structure, by a corresponding object retaining space.

10. The device of claim 9 further comprising said oblong sidewall structures of said first pair of oblong sidewall structures being further joined by a dividing bar near said mounting side ends thereof adjacent said ejector button extending outward from said connection structure to be alongside said dividing bar.

11. The device of claim 9 wherein said accommodating sidewall structure farthest from said first sidewall structure pair has a sidewall opening therein at said mounting side end thereof across from said sidewall opening in a said oblong sidewall structure in said first pair of oblong sidewall structures in which said pivot pin is concurrently positionable concurrently, and also removable therefrom.

12. The device of claim 9 wherein said oblong object holder is a first oblong object holder and said object retaining space is a first object retaining space, and further comprising a second oblong object holder having a connection structure at a connection end thereof and supporting a selected object to be held in said holder at an opposite support end thereof, said connection structure having a pair of connection bars each extending away from said support end and about an opposite side of a connection opening between them to result in gap ends thereof facing one another across a connection gap extending between them from said connection opening, said connection opening having opposite sides thereof separated by distances larger than distances across said pivot pin at said second and said corresponding object retaining spaces when said pivot pin is extending concurrently through each of said sidewall openings, said connection bars formed of a resilient material sufficiently resilient to allow said gap ends to be forced away from one another far enough to allow said pivot pin to pass between them, said oblong object holder and any oblong object supported at said support end thereof being thin enough in a direction perpendicular to the direction of extent of said connection bars about said connection opening to be positioned in at least one of said second and said corresponding object retaining spaces.

* * * * *